US010779657B1

(12) United States Patent
Martin

(10) Patent No.: US 10,779,657 B1
(45) Date of Patent: Sep. 22, 2020

(54) ADJUSTABLE FOOT STOOL

(71) Applicant: Teresa Martin, Oak Ridge, NJ (US)

(72) Inventor: Teresa Martin, Oak Ridge, NJ (US)

( * ) Notice: Subject to any disclaimer, the term of this patent is extended or adjusted under 35 U.S.C. 154(b) by 0 days.

(21) Appl. No.: 16/398,436

(22) Filed: Apr. 30, 2019

(51) Int. Cl.
*A47C 16/02* (2006.01)
*A47C 7/72* (2006.01)

(52) U.S. Cl.
CPC ..... *A47C 16/025* (2013.01); *A47C 7/725* (2013.01)

(58) Field of Classification Search
CPC ..... A47C 16/025; A47C 7/725
USPC ..... 297/423.44, 423.45, 423.46
See application file for complete search history.

(56) References Cited

U.S. PATENT DOCUMENTS 38,619 A 5/1863 Wilkins
5,234,396 A * 8/1993 Wilkinson ..... A63B 23/0458 248/396
6,871,364 B1 3/2005 Leoutsakos
7,360,841 B2 4/2008 Barlow
8,616,652 B1 12/2013 Wells
8,911,021 B1 12/2014 Styke
2010/0163055 A1 7/2010 Wilkinson
2016/0360937 A1* 12/2016 Naik ..... A47C 16/025
2019/0274495 A1* 9/2019 Leavitt ..... A47K 17/028

FOREIGN PATENT DOCUMENTS

WO 2009007705 1/2009

* cited by examiner

*Primary Examiner* — Anthony D Barfield

(57) ABSTRACT

The adjustable foot stool comprises a platform, a pad, a plurality of lighting elements, and a pair of adjustable legs. The platform may be adapted to elevate and tilt a foot of a user. An inclination angle of the platform may be changed using the pair of adjustable legs. The pad may cushion the foot 910. The plurality of lighting elements may be adapted to provide illumination of the foot. As a non-limiting example, illumination may be provided for grooming the foot. The plurality of lighting elements may be powered by one or more batteries housed within the platform and may be turned on or off using an on/off switch located on the platform.

9 Claims, 4 Drawing Sheets

ADJUSTABLE FOOT STOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of foot care, more specifically, an adjustable foot stool.

SUMMARY OF INVENTION

The adjustable foot stool comprises a platform, a pad, a plurality of lighting elements, and a pair of adjustable legs. The platform may be adapted to elevate and tilt a foot of a user. An inclination angle of the platform may be changed using the pair of adjustable legs. The pad may cushion the foot. The plurality of lighting elements may be adapted to provide illumination of the foot. As a non-limiting example, illumination may be provided for grooming the foot. The plurality of lighting elements may be powered by one or more batteries housed within the platform and may be turned on or off using an on/off switch located on the platform.

An object of the invention is to elevate and tilt a user's foot.

Another object of the invention is to cushion the foot while the foot is resting on the top of the foot stool.

A further object of the invention is to provide a pair of adjustable legs to adjust the height of the front of the foot stool and thereby change the inclination angle of the foot stool.

Yet another object of the invention is to provide a plurality of lighting elements along the sides of the foot to illuminate the foot when an on/off switch is activated.

These together with additional objects, features and advantages of the adjustable foot stool will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable foot stool in detail, it is to be understood that the adjustable foot stool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable foot stool.

It is therefore important that the claims be regarded as including such equivalent construction insofar as they do not depart from the spirit and scope of the adjustable foot stool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
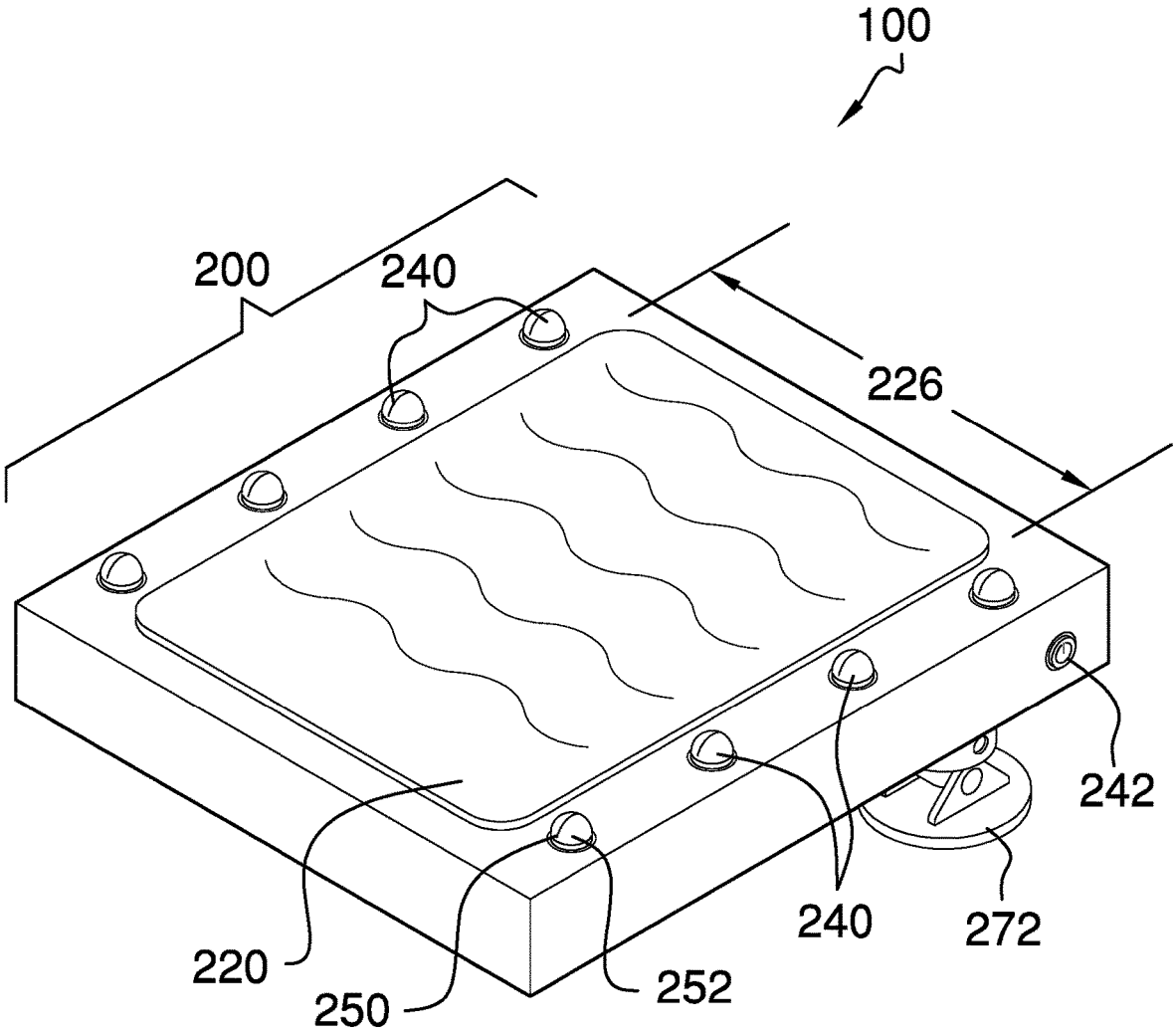
FIG. 1 is a perspective view of an embodiment of the disclosure.
Figure 2:
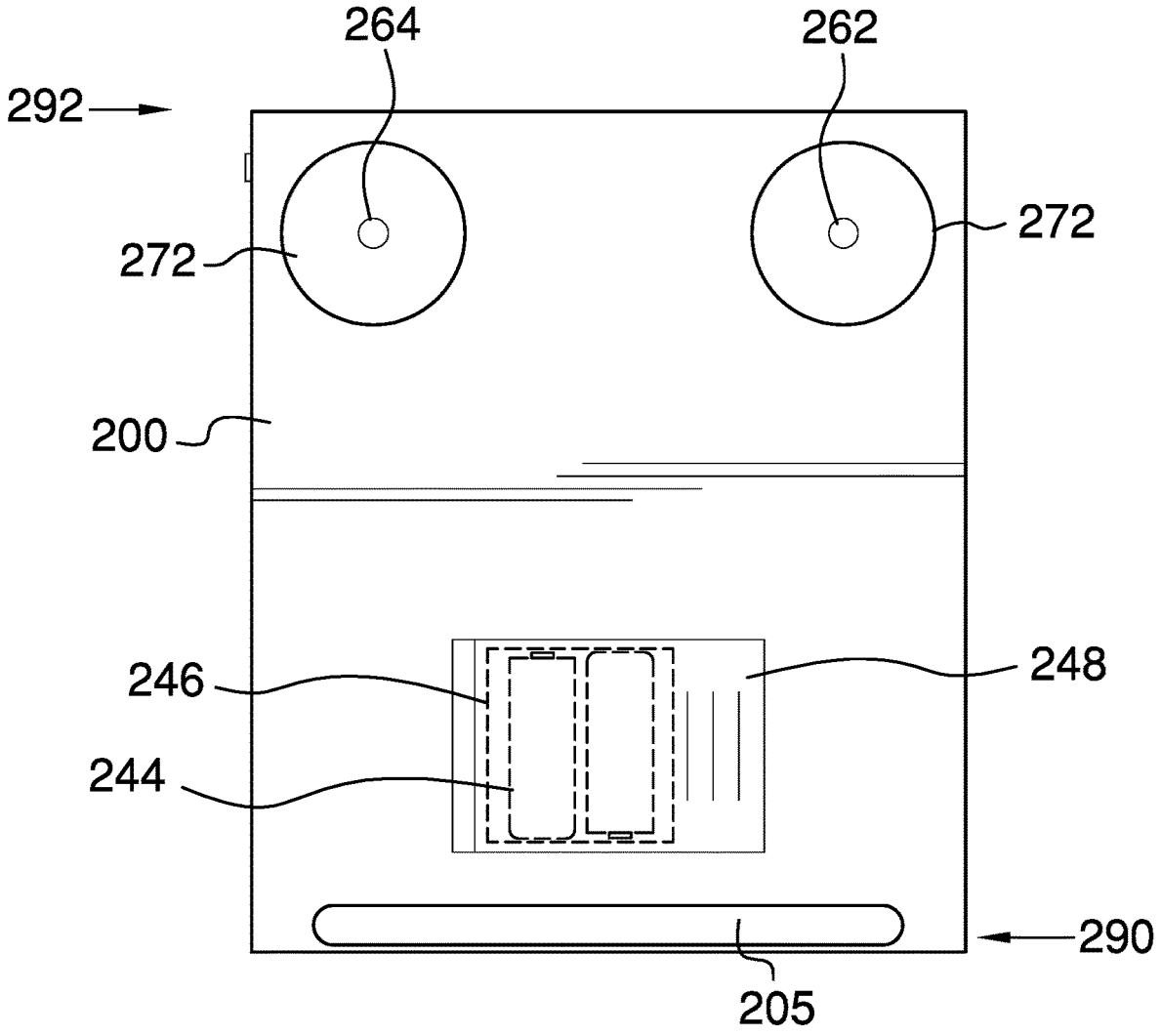
FIG. 2 is a bottom view of an embodiment of the disclosure.
Figure 3:
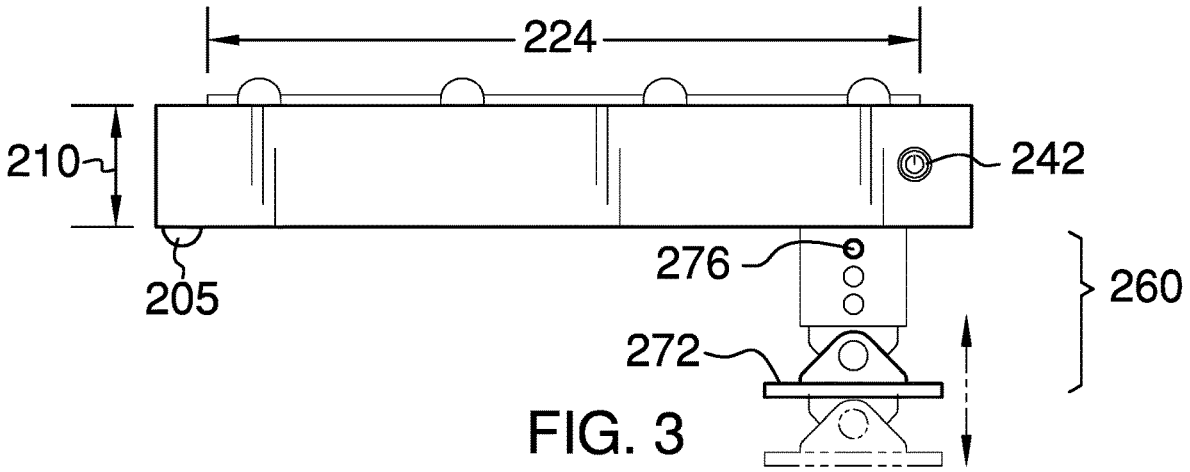
FIG. 3 is a side view of an embodiment of the disclosure.
Figure 4:
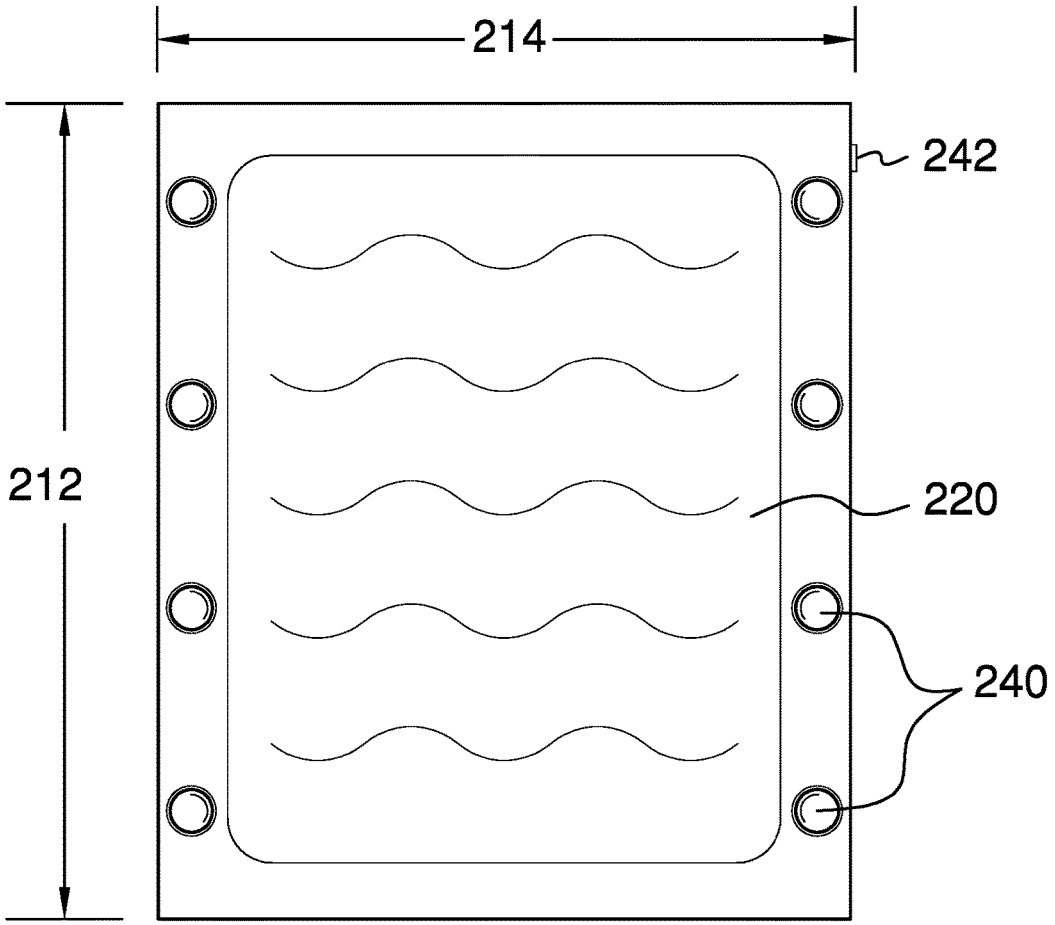
FIG. 4 is a top view of an embodiment of the disclosure.
Figure 5:
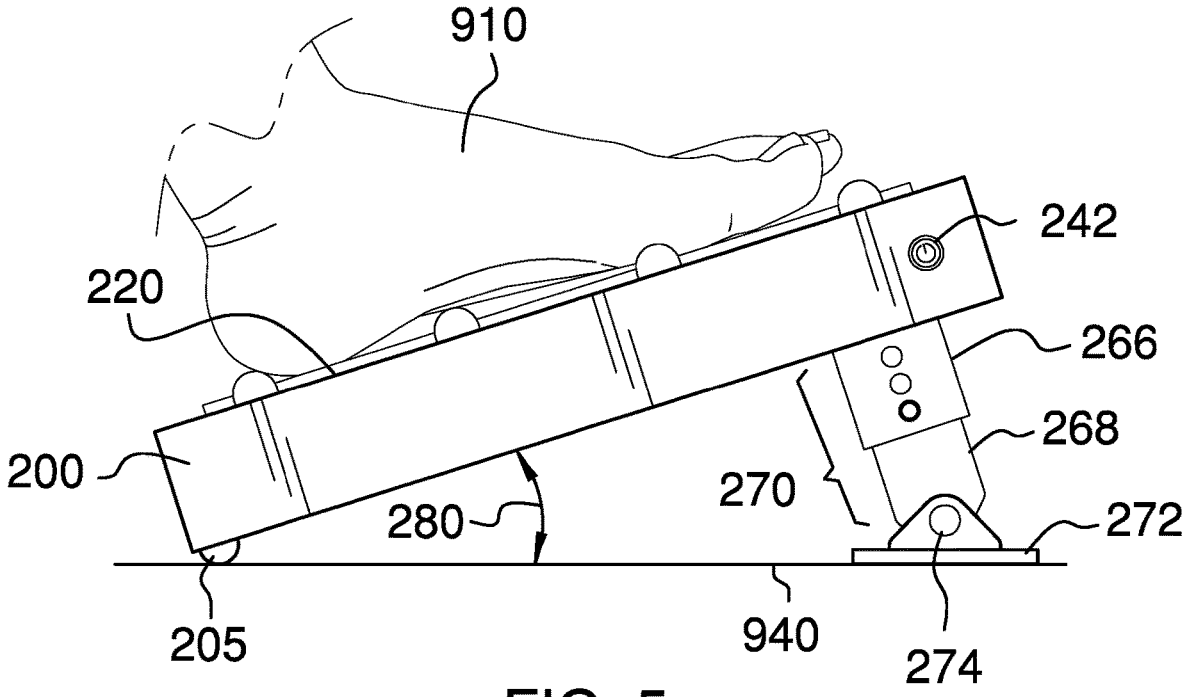
FIG. 5 is an in-use view of an embodiment of the disclosure.

Detailed reference will now be made to a first potential embodiment of the disclosure, which is illustrated in FIGS. 1 through 5.

The adjustable foot stool 100 (hereinafter invention) comprises a platform 200, a pad 220, a plurality of lighting elements 240, and a pair of adjustable legs 260. The platform 200 may be adapted to elevate and tilt a foot 910 of a user. An inclination angle 280 of the platform 200 may be changed using the pair of adjustable legs 260. The pad 220 may cushion the foot 910. The plurality of lighting elements 240 may be adapted to provide illumination of the foot 910. As a non-limiting example, illumination may be provided for grooming the foot 910.

The platform 200 may be an enclosure that is adapted to lift the foot 910 of the user by a height determined by a platform thickness 210. A platform length 212 may be adapted to be at least as long as a human foot. A platform width 214 may be adapted to be at least as wide as the human foot. One or more fixed supports 205 may be coupled to the bottom surface of the platform 200 on a proximal end 290. The pair of adjustable legs 260 may be coupled to the bottom surface of the platform 200 on a distal end 292. The pad 220 may be coupled to the top surface of the platform 200.

The pad 220 may be coupled to the center of the top surface of the platform 200. A pad length 224 may be adapted to be at least as long as the human foot and no longer than the platform length 212. A pad width 226 may be adapted to be at least as wide as the human foot and no wider than the platform width 214.

The plurality of lighting elements 240 may be coupled to the top surface of the platform 200. The plurality of lighting elements 240 may be aligned into two rows—one on the left side of the platform 200 and one on the right side of the platform 200. The plurality of lighting elements 240 may be turned on or off via an on/off switch 242. Each individual light 250 selected from the plurality of lighting elements 240 may be covered by a shroud 252 that may direct the illumination from the individual light 250 laterally towards the center of the platform 200 and may prevent the illumination from shining upwards. This may prevent the plurality of lighting elements from shining in the user's eyes.

The pair of adjustable legs 260 may comprise a left adjustable leg 262 and a right adjustable leg 264. The pair of adjustable legs 260 may be extended to increase the height of the distal end 292 of the platform 200 to increase the elevation of the top surface of the platform 200 and to provide a more comfortable the inclination angle 280. The left adjustable leg 262 may be located on the left side of the platform 200 and the right adjustable leg 264 may be located on the right side of the platform 200.

The height of an individual adjustable leg 270 selected from the pair of adjustable legs 260 may be changed by disengaging a lock 276 on the individual adjustable leg 270, extending or retracting the individual adjustable leg 270, and engaging the lock 276. The individual adjustable leg 270 may comprise an upper leg portion 266 and a lower leg portion 268. The lower leg portion 268 may be free to slide within the upper leg portion 266 when the lock 276 is disengaged which may allow extension or retraction of the individual adjustable leg 270. In some embodiments, the lock 276 may be disengaged by pressing the lock 276 and may be engaged by releasing the lock 276.

The individual adjustable leg 270 may comprise a base 272. The base 272 may pivot at a pivot point 274 such that the bottom of the base 272 remains in flat contact with a floor 940 as the inclination angle 280 of the platform 200 changes.

The platform 200 may house one or more batteries 244 in a battery compartment 246 that is accessible via a battery compartment door 248 located on the bottom surface of the platform 200. The one or more batteries 244 may comprise one or more energy-storage devices. The one or more batteries 244 may be a source of electrical energy to operate the plurality of lighting elements 240. The one or more batteries 244 may be replaceable or rechargeable.

In use, the platform 200 may be placed in front of the user and the inclination angle 280 may be adjusted by extending the pair of adjustable legs 260 on the distal end 292 of the platform 200. The user may place the foot 910 onto the pad 220 and the pad 220 may cushion the foot 910. If the user wishes to groom the foot 910, they may turn the plurality of lighting elements 240 on using the on/off switch 242.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, the word "lateral" refers to the sides of an object or movement towards a side. Lateral directions are generally perpendicular to longitudinal directions. "Laterally" refers to movement in a lateral direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "switch" is an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An adjustable foot stool comprising:

a platform, a pad, a plurality of lighting elements, and a pair of adjustable legs;

wherein the platform is adapted to elevate and tilt a foot of a user;

wherein an inclination angle of the platform is changed using the pair of adjustable legs;

wherein the pad cushions the foot;

wherein the plurality of lighting elements are adapted to provide illumination of the foot;

wherein the platform is an enclosure that is adapted to lift the foot of the user by a height determined by a platform thickness;

wherein a platform length is adapted to be at least as long as a human foot;

wherein a platform width is adapted to be at least as wide as the human foot;

wherein one or more fixed supports are coupled to the bottom surface of the platform on a proximal end;

wherein the pair of adjustable legs are coupled to the bottom surface of the platform on a distal end;

wherein the pad is coupled to the top surface of the platform;

wherein the pad is coupled to the center of the top surface of the platform;

wherein a pad length is adapted to be at least as long as the human foot and no longer than the platform length;

wherein a pad width is adapted to be at least as wide as the human foot and no wider than the platform width;

wherein the plurality of lighting elements are coupled to a top surface of the platform;

wherein the plurality of lighting elements are aligned into two rows with one on the left side of the platform and one on the right side of the platform.

2. The adjustable foot stool according to claim 1 wherein the plurality of lighting elements are turned on or off via an on/off switch.

3. The adjustable foot stool according to claim 2 wherein each individual light selected from the plurality of lighting elements is covered by a shroud that directs the illumination from the individual light laterally towards the center of the platform and prevents the illumination from shining upwards.

4. The adjustable foot stool according to claim 3 wherein the pair of adjustable legs comprises a left adjustable leg and a right adjustable leg;

wherein the pair of adjustable legs are extended to increase the height of the distal end of the platform to increase the elevation of the top surface of the platform and to provide a more comfortable the inclination angle;

wherein the left adjustable leg is located on the left side of the platform and the right adjustable leg is located on the right side of the platform.

5. The adjustable foot stool according to claim 4 wherein the height of an individual adjustable leg selected from the pair of adjustable legs is changed by disengaging a lock on the individual adjustable leg, extending or retracting the individual adjustable leg, and engaging the lock.

6. The adjustable foot stool according to claim 5 wherein the individual adjustable leg comprises an upper leg portion and a lower leg portion;

wherein the lower leg portion is free to slide within the upper leg portion when the lock is disengaged allowing extension or retraction of the individual adjustable leg.

7. The adjustable foot stool according to claim 6 wherein the lock is disengaged by pressing the lock and is engaged by releasing the lock.

8. The adjustable foot stool according to claim 7 wherein the individual adjustable leg comprises a base;

wherein the base pivots at a pivot point such that the bottom of the base remains in flat contact with a floor as the inclination angle of the platform changes.

9. The adjustable foot stool according to claim 8 wherein the platform houses one or more batteries in a battery compartment that is accessible via a battery compartment door located on the bottom surface of the platform;

wherein the one or more batteries comprise one or more energy-storage devices;

wherein the one or more batteries are a source of electrical energy to operate the plurality of lighting elements;

wherein the one or more batteries are replaceable or rechargeable.

* * * * *